US011247862B2

(12) United States Patent
Shibayama

(10) Patent No.: US 11,247,862 B2
(45) Date of Patent: Feb. 15, 2022

(54) SHEET FEEDING DEVICE AND IMAGE FORMING DEVICE

(71) Applicant: SHARP KABUSHIKI KAISHA, Sakai (JP)

(72) Inventor: Tsuyoshi Shibayama, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 161 days.

(21) Appl. No.: 16/541,514

(22) Filed: Aug. 15, 2019

(65) Prior Publication Data

US 2020/0071108 A1 Mar. 5, 2020

(30) Foreign Application Priority Data

Aug. 29, 2018 (JP) ..... JP2018-160655

(51) Int. Cl.

| | |
|---|---|
| ***B65H 1/26*** | (2006.01) |
| ***B65H 7/04*** | (2006.01) |
| ***B65H 11/02*** | (2006.01) |
| ***B65H 7/02*** | (2006.01) |
| ***B65H 1/18*** | (2006.01) |

(52) U.S. Cl.

CPC ..... *B65H 11/02* (2013.01); *B65H 1/18* (2013.01); *B65H 7/02* (2013.01); *B65H 7/04* (2013.01); *B65H 2301/413223* (2013.01); *B65H 2511/51* (2013.01)

(58) Field of Classification Search

CPC ... B65H 7/04; B65H 7/02; B65H 7/14; B65H 1/266; B65H 2511/51; B65H 2511/515; B65H 2553/612; B65H 1/18; B65H 11/02; B65H 2301/413223

See application file for complete search history.

(56) References Cited

U.S. PATENT DOCUMENTS 8,641,037 B2 * 2/2014 Tokuda ..... B65H 7/04 271/162
2007/0081199 A1 4/2007 Koga et al.

FOREIGN PATENT DOCUMENTS

| | | | | |
|---|---|---|---|---|
| CN | 1923648 A | | 3/2007 | |
| JP | 61051423 A | * | 3/1986 | ..... B65H 1/266 |
| JP | 61238633 A | * | 10/1986 | |
| JP | 04041347 A | * | 2/1992 | |
| JP | 09272644 A | * | 10/1997 | |
| JP | 2005-029377 A | | 2/2005 | |

* cited by examiner

*Primary Examiner* — Luis A Gonzalez
(74) *Attorney, Agent, or Firm* — ScienBiziP, P.C.

(57) ABSTRACT

A detector includes a first member that makes contact with an upper surface of a paper sheet stored in a sheet feeding cassette, and a second member that supports the first member such that it is capable changing postures, while also movably supporting the first member in an up-and-down direction to coincide with the upper surface of a paper sheet stored in the sheet feeding cassette. The first member has a guide portion that makes contact with the sheet feeding cassette and/or a paper sheet stored in the sheet feeding cassette. The first member changes postures with respect to the second member as a result of the guide portion making contact with the sheet feeding cassette and/or a paper sheet stored in the sheet feeding cassette.

7 Claims, 17 Drawing Sheets

SHEET FEEDING DEVICE AND IMAGE FORMING DEVICE

BACKGROUND OF THE INVENTION

Field of the Invention

The present invention relates to a sheet feeding device provided with a sheet feeding cassette, and an image forming device provided with a sheet feeding device.

Description of the Background Art

A sheet feeding device provided with a sheet feeding cassette is known as a sheet feeding device provided in an image forming device. A sheet feeding cassette can be switched between a mounted state, in which the sheet feeding cassette is mounted to a sheet feeding cassette mounting portion on an image forming device body, and a pulled-out state, in which the sheet feeding cassette has been pulled out from the sheet feeding cassette mounting portion. In the mounted state, paper sheets can be fed from the sheet feeding cassette to an image forming device body. Further, in the pulled-out state, paper sheets can be replenished or replaced.

A sheet feeding device is provided with a detector that detects the amount of paper sheets stored in the sheet feeding cassette or whether a paper sheet is present. The detector makes contact with a paper sheet stored in the sheet feeding cassette, and a detection signal is output to a controller of the image forming device. The controller determines, based on the detection signal, the amount of paper sheets stored in the sheet feeding cassette or whether a paper sheet is present.

FIGS. 15 A to 15C are simplified side views illustrating an operation of a conventional sheet feeding cassette 310 and detector 350. As illustrated in FIGS. 15A to 15C, the sheet feeding cassette 310 is moved with respect to a sheet feeding cassette mounting portion in order to switch from the mounted state to the pulled-out state. The direction in which the sheet feeding cassette 310 is moved when being switched from the mounted state to the pulled-out state is defined as a pull-out direction D1. The direction in which the sheet feeding cassette 310 is moved when being switched from the pulled-out state to the mounted state is defined as a mounting direction D2. FIG. 15A illustrates a state where the sheet feeding cassette 310 is in the pulled-out state, and the sheet feeding cassette 310 is being moved in the mounting direction D2.

The detector 350 is provided on the sheet feeding cassette mounting portion side. When the sheet feeding cassette 310 is switched from the mounted state to the pulled-out state, the detector 350 separates from the sheet feeding cassette 310 and is switched from a state in which a paper sheet P in the sheet feeding cassette 310 is detected to a state where a paper sheet P is not detected. The detector 350 includes a detector main body 351 and a guide portion 352.

The detector main body 351 is rotatably supported in an R11 direction with respect to a support portion 360. The guide portion 352 makes contact with a corner portion 311 of the sheet feeding cassette 310 and a corner portion P11 of a paper sheet P stored in the sheet feeding cassette 310, thereby guiding the detector 350 so as to rotate in the R11 direction.

In FIG. 15A, the corner portion 311 of the sheet feeding cassette 310 is making contact with the guide portion 352. When the corner portion 311 of the sheet feeding cassette 310 makes contact with the guide portion 352, the guide portion 352 guides the detector 350 so as to rotate in the R11 direction.

FIG. 15B illustrates a state where the detector 350 has rotated in the R11 direction, and the guide portion 352 has moved up onto the sheet feeding cassette 310. When the sheet feeding cassette 310 moves further in the mounting direction D2 from the state of FIG. 15B such that the corner portion P11 of a paper sheet P makes contact with the guide portion 352, in an equivalent manner those cases where the corner portion 311 of the sheet feeding cassette 310 makes contact, the guide portion 352 guides the detector 350 so as to rotate in the R11 direction, and the detector 350 moves up onto an upper surface of a paper sheet P. When the detector 350 has moved up onto the upper surface of a paper sheet P, the detector 350 is in a state where a paper sheet P in the sheet feeding cassette 310 is detected.

However, as illustrated in FIG. 15C, when the sheet feeding cassette 310 is moved in the mounting direction D2 and the corner portion 311 of the sheet feeding cassette 310 makes contact with the guide portion 352, the direction of a force F received by the guide portion 352 from the sheet feeding cassette 310 and the R11 direction in which the detector 350 rotates become mutually opposite directions. Consequently, the guide portion 352 can sometimes become caught on the corner portion 311 of the sheet feeding cassette 310 due to being unable to rotate in the R11 direction, causing the detector 350 to not smoothly move up onto the upper surface of the sheet feeding cassette 310. Furthermore, those cases where the corner portion P11 of a paper sheet P makes contact with the guide portion 352 are equivalent, in which the guide portion 352 can become caught on the corner portion P11 of a paper sheet P and cause the detector 350 to not smoothly move up onto the upper surface of a paper sheet P. If the guide portion 352 becomes caught on the sheet feeding cassette 310 or a paper sheet P, it becomes difficult for the sheet feeding cassette 310 to be smoothly moved from the pulled-out state to the mounted state.

Moreover, a user may sometimes strongly or forcibly move the sheet feeding cassette 310 in the mounting direction D2. In such cases, when the corner portion 311 of the sheet feeding cassette 310 or the corner portion P11 of a paper sheet P collides and becomes caught on the guide portion 352, a strong impact is applied to the guide portion 352 and there is a concern that damage may occur to the detector 350.

Japanese Unexamined Patent Application Publication No. 2005-29377 discloses a technique of providing a rollable movable member on a front end portion of a paper sheet detector. However, in the technique disclosed in Japanese Unexamined Patent Application Publication No. 2005-29377, reduction of the impact is not considered with respect to a collision by a sheet feeding cassette or a paper sheet from the side of the detector.

An object of the present invention is to provide a sheet feeding device and an image forming device capable of reducing the impact received by a detector when a sheet feeding cassette, which is moved to switch between a mounted state and a pulled-out state, and/or a paper sheet stored in the sheet feeding cassette makes contact with the detector.

SUMMARY OF THE INVENTION

A sheet feeding device of the present invention includes a sheet feeding cassette which is switchable between a mounted state, in which the sheet feeding cassette is mounted to a sheet feeding cassette mounting portion on an image forming device body, and a pulled-out state, in which the sheet feeding cassette has been pulled out from the sheet feeding cassette mounting portion, wherein a detector is provided that makes contact with a paper sheet stored in the sheet feeding cassette and detects a paper sheet amount, the detector includes a first member that makes contact with an upper surface of a paper sheet stored in the sheet feeding cassette, and a second member that supports the first member such that the first member is capable of changing postures, while also movably supporting the first member in an up-and-down direction to coincide with an upper surface of a paper sheet stored in the sheet feeding cassette, the first member includes a guide portion that makes contact with the sheet feeding cassette, which is moved to switch between the mounted state and the pulled-out state, and/or a paper sheet stored in the sheet feeding cassette, and the first member changes a posture with respect to the second member as a result of the guide portion making contact with the sheet feeding cassette, which is moved to switch between the mounted state and the pulled-out state, and/or a paper sheet stored in the sheet feeding cassette (first configuration).

According to the configuration above, the first member changes a posture with respect to the second member as a result of the guide portion making contact with the sheet feeding cassette and/or a paper sheet stored in the sheet feeding cassette. Consequently, the impact received by the detector can be reduced when the sheet feeding cassette, which is moved to switch between the mounted state and the pulled-out state, and/or a paper sheet stored in the sheet feeding cassette makes contact with the detector.

In the first configuration above, the guide portion may be is disposed so as to make contact with a section in which an upper surface of the sheet feeding cassette intersects a front side surface of the sheet feeding cassette in a mounting direction and/or a section in which an upper surface of a paper sheet stored in the sheet feeding cassette intersects a front side surface of the paper sheet stored in the sheet feeding cassette in the mounting direction, the mounting direction being a direction in which the sheet feeding cassette is moved when switching from the pulled-out state to the mounted state (second configuration).

According to the configuration above, the guide portion is disposed so as to make contact with a section in which an upper surface of the sheet feeding cassette intersects a front side surface of the sheet feeding cassette in the mounting direction and/or a section in which an upper surface of a paper sheet stored in the sheet feeding cassette intersects a front side surface of the paper sheet stored in the sheet feeding cassette in the mounting direction. Consequently, the guide portion is capable of smoothly moving up onto the sheet feeding cassette and/or a paper sheet stored in the sheet feeding cassette.

In the first or second configurations above, the first member may change a posture with respect to the second member as a result of the guide portion making contact with the sheet feeding cassette and/or a paper sheet stored in the sheet feeding cassette, such that an angle formed by the guide portion and an upper surface of the sheet feeding cassette and/or an upper surface of a paper sheet stored in the sheet feeding cassette decreases (third configuration).

According to the configuration above, the first member changes a posture with respect to the second member as a result of the guide portion making contact with the sheet feeding cassette and/or a paper sheet stored in the sheet feeding cassette, such that an angle formed by the guide portion and an upper surface of the sheet feeding cassette and/or an upper surface of a paper sheet stored in the sheet feeding cassette decreases. Consequently, the first member is capable of smoothly moving up onto the sheet feeding cassette and/or a paper sheet stored in the sheet feeding cassette, and the impact received by the detector can be reduced.

In any one of the first to third configurations above, the first member may be rotatably provided with respect to the second member (fourth configuration).

According to the configuration above, the first member is rotatably provided with respect to the second member. Consequently, the first member is capable of changing postures by rotating with respect to the second member.

In any one of the first to the fourth configurations above, a biasing member may be included that biases the first member with respect to the second member such that the first member takes a detection posture, the detection posture being a posture of the first member with respect to the second member in a state where the guide portion is not making contact with the sheet feeding cassette and/or a paper sheet stored in the sheet feeding cassette. (fifth configuration).

According to the configuration above, the biasing member biases the first member with respect to the second member such that the first member takes the detection posture. Consequently, the first member takes the detection posture when the guide portion makes contact with the sheet feeding cassette and/or a paper sheet stored in the sheet feeding cassette, and the impact received by the detector can be reduced.

In the fifth configuration above, the biasing member may have a biasing force which is set such that the first member takes the detection posture when the first member is positioned on an upper surface of the sheet feeding cassette and/or a paper sheet stored in the sheet feeding cassette (sixth configuration).

According to the configuration above, the first member takes the detection posture when the first member is positioned on an upper surface of the sheet feeding cassette and/or a paper sheet stored in the sheet feeding cassette. Consequently, the posture of the first member with respect to the second member becomes constant, and detection of a paper sheet stored in the sheet feeding cassette can be accurately performed.

In any one of the first to sixth configurations above, a restriction portion may be included that restricts a posture change of the first member with respect to the second member to a predetermined range when the guide portion is making contact with the sheet feeding cassette and/or a paper sheet stored in the sheet feeding cassette (seventh configuration).

According to the configuration above, the restriction portion restricts a posture change of the first member with respect to the second member to a predetermined range. Consequently, the first member more easily moves up onto the sheet feeding cassette and/or a paper sheet stored in the sheet feeding cassette.

An image forming device of the present invention includes a sheet feeding device according to any one of the first to seventh configurations above (eighth configuration).

According to the configuration above, the first member changes a posture with respect to the second member as a result of the guide portion making contact with the sheet feeding cassette and/or a paper sheet stored in the sheet feeding cassette. Consequently, the impact received by the detector can be reduced when the sheet feeding cassette, which is moved to switch between the mounted state and the pulled-out state, and/or a paper sheet stored in the sheet feeding cassette makes contact with the detector.

According to the sheet feeding device and the image forming device of the present invention, it is possible to reduce the impact received by a detector when a sheet feeding cassette, which is moved to switch between a mounted state and a pulled-out state, and/or a paper sheet stored in the sheet feeding cassette makes contact with the detector.

DESCRIPTION OF THE PREFERRED EMBODIMENTS

First Embodiment

Figure 1:
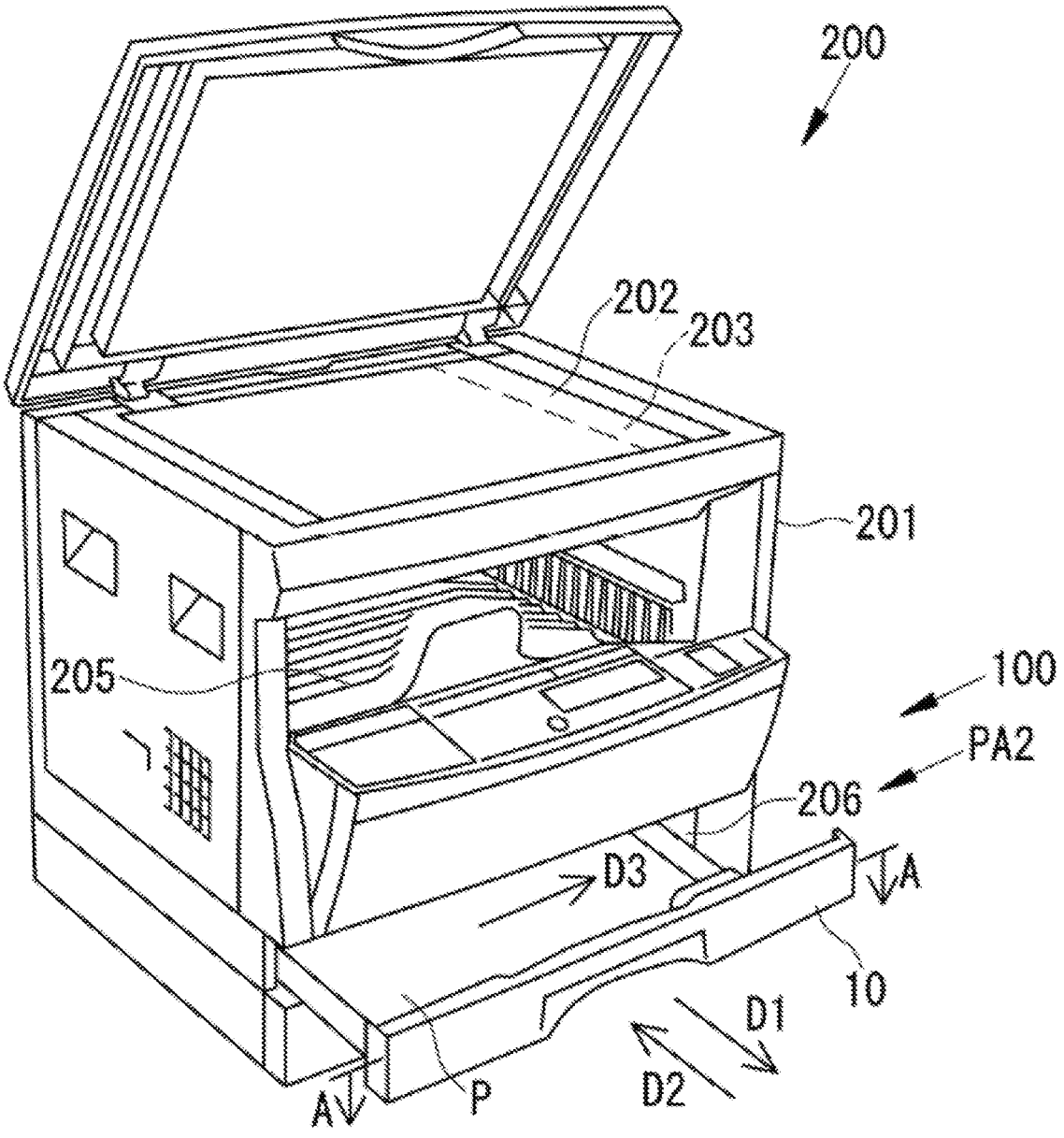
FIG. 1 is a perspective view illustrating an overall configuration of an image forming device to which a sheet feeding device according to a first embodiment is applied.

Hereinafter, embodiments of the present invention will be described based on the drawings. FIG. 1 is a perspective view illustrating an overall configuration of an image forming device 200 to which a sheet feeding device 100 according to a first embodiment is applied. The image forming device 200 includes an image forming device body 201, a document table 202, a scanner 203, a paper discharge tray 205, a sheet feeding cassette mounting portion 206, and a sheet feeding device 100.

The image forming device body 201 is the body section of the image forming device 200. The document table 202 is a glass body installed on an upper surface of the image forming device body 201. The scanner 203 is provided below the document table 202, and reads an image of a document placed on the document table 202. An image forming unit is provided inside the image forming device body 201. The image data read by the scanner 203 is input to the image forming unit, and an image based on the image data is formed on the surface of a paper sheet by the electrographic image forming method. The paper discharge tray 205 is installed to the upper center of the image forming device body 201 (a position below the scanner 203), and discharges a paper sheet on which the image is formed.

The sheet feeding device 100 of the present embodiment is provided below the paper discharge tray 205. The sheet feeding device 100 is provided with two sheet feeding cassette mounting portions 206 on an upper and lower level. The sheet feeding cassette 10 is mounted to the sheet feeding cassette mounting portions 206.

Figure 2:
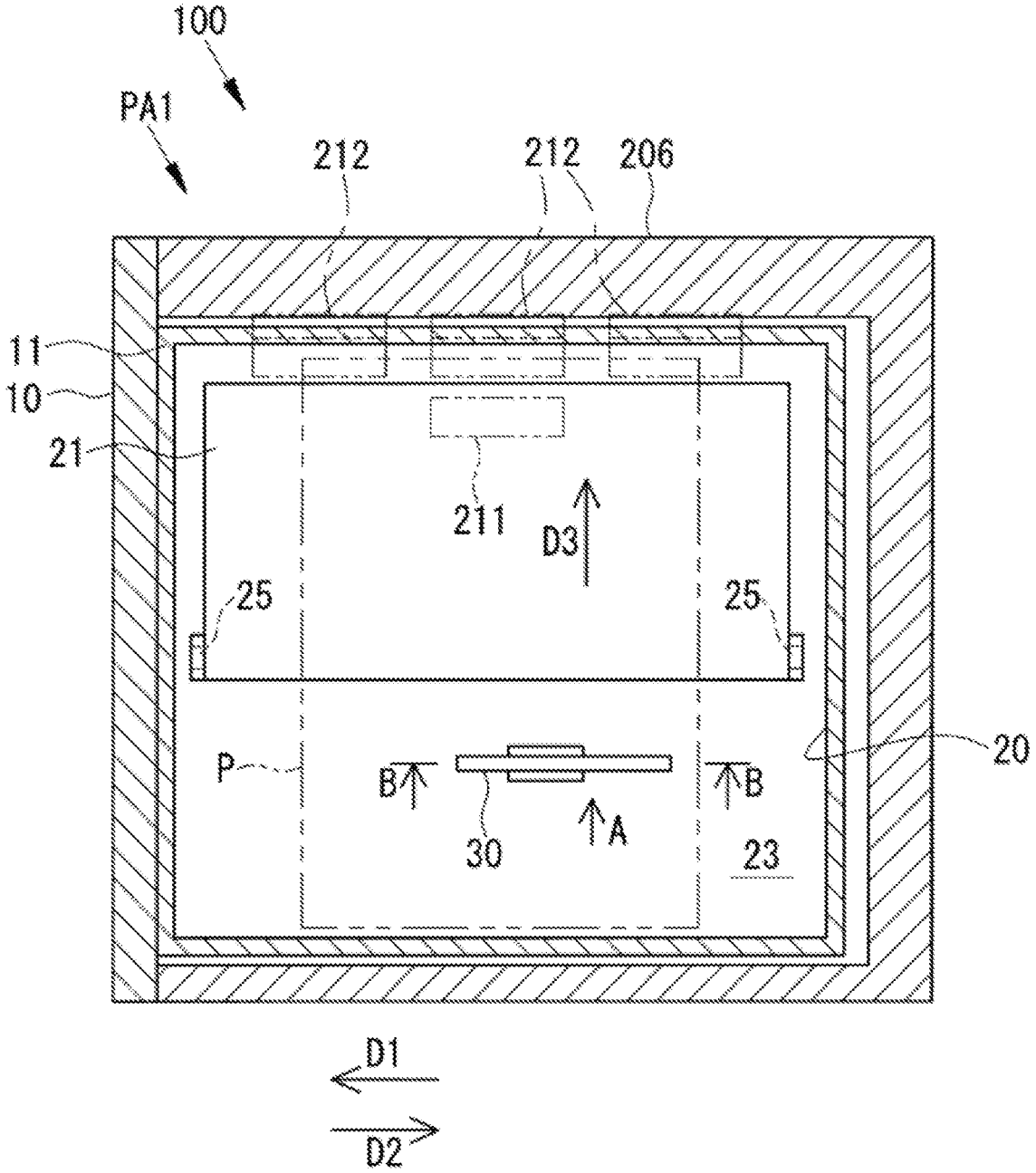
FIG. 2 is a cross-sectional view cut at the position of line A-A in FIG. 1, and is a plan view schematically illustrating a mounted state in which a sheet feeding cassette is mounted to a sheet feeding cassette mounting portion.
Figure 3:
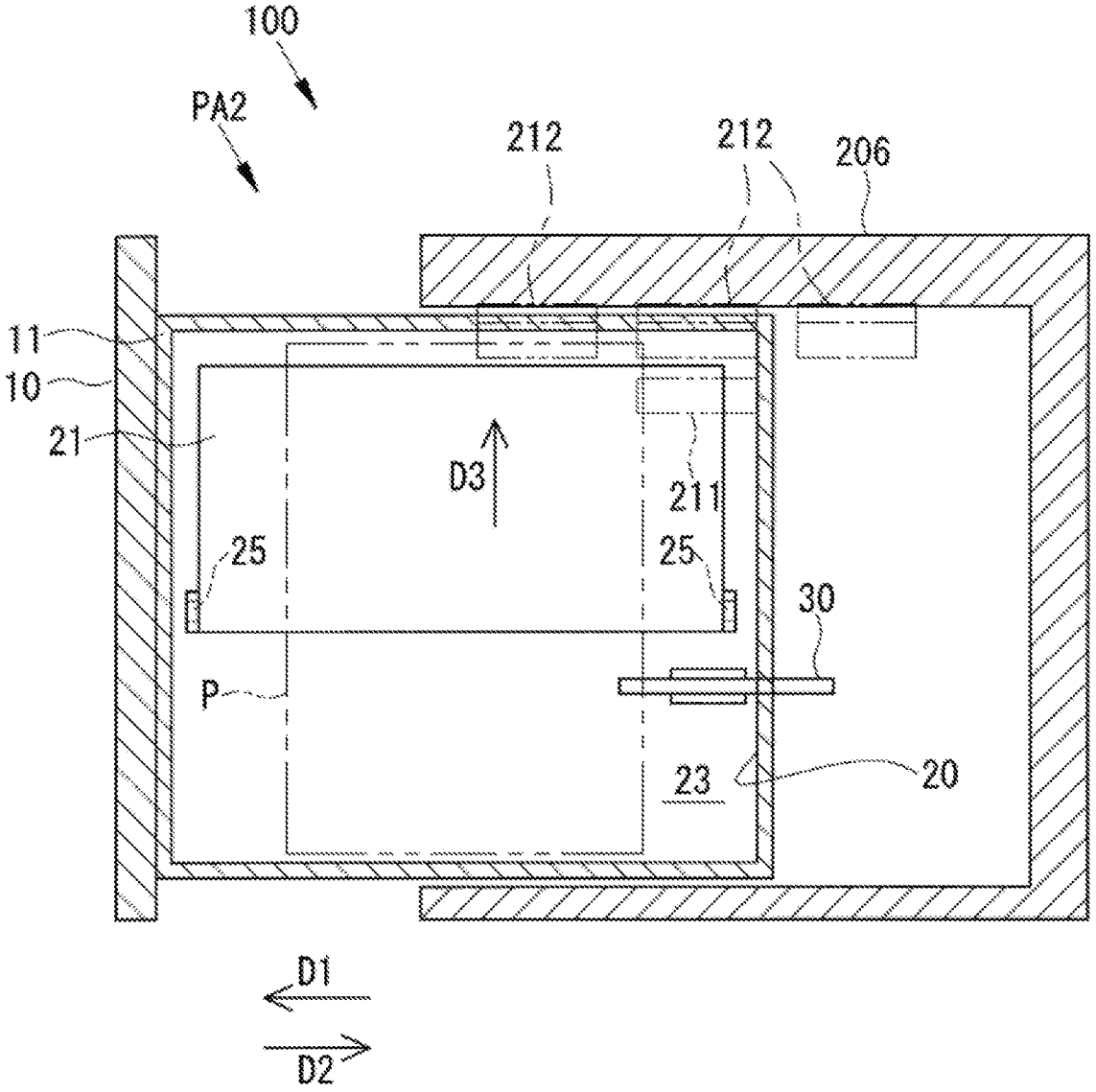
FIG. 3 is a cross-sectional view cut at the position of line A-A in FIG. 1, and is a plan view schematically illustrating a pulled-out state in which the sheet feeding cassette has been pulled out from the sheet feeding cassette mounting portion.

The sheet feeding cassette 10 can be switched between a mounted state PA1 (see FIG. 2) and a pulled-out state PA2 (see FIG. 3). The mounted state PA1 (see FIG. 2) is a state where the sheet feeding cassette 10 is mounted to the sheet feeding cassette mounting portion 206. The pulled-out state PA2 is a state where the sheet feeding cassette 10 has been pulled out from the sheet feeding cassette mounting portion 206. The sheet feeding cassette 10 illustrated in FIG. 1 is in the pulled-out state PA2, and can be switched to the mounted state PA1 by pushing the sheet feeding cassette 10 into the sheet feeding cassette mounting portion 206 from the front side toward the back side in the drawing. The direction in which the sheet feeding cassette 10 is moved when switching from the mounted state PA1 to the pulled-out state PA2 is referred to as a pull-out direction D1. The direction in which the sheet feeding cassette 10 is moved when switching from the pulled-out state PA2 to the mounted state PA1 is referred to as a mounting direction D2.

Sheet Feeding Device

Next, the sheet feeding device 100 will be described. FIG. 2 is a cross-sectional view cut at the position of line A-A in FIG. 1, and is a plan view schematically illustrating the mounted state PA1 in which the sheet feeding cassette 10 is mounted to the sheet feeding cassette mounting portion 206. FIG. 3 is a cross-sectional view cut at the position of line A-A in FIG. 1, and is a plan view schematically illustrating the pulled-out state PA2 in which the sheet feeding cassette 10 has been pulled out from the sheet feeding cassette mounting portion 206. As illustrated in FIG. 2 and FIG. 3, the sheet feeding cassette 10 includes a sheet feeding cassette body 11, a storage portion 20, and a movable placement plate 21.

The sheet feeding cassette body 11 is a section that forms the base of the sheet feeding cassette 10.

The storage portion 20 is formed inside the sheet feeding cassette body 11. A paper sheet P is stored in the storage portion 20. A paper sheet guide (not illustrated) is provided in the storage portion 20. The position of the paper sheet guide can be adjusted such that paper sheets P of various sizes (for example, A4, A3, B5, and B4) can be stored in the storage portion 20. In the mounted state PA1, a paper sheet P stored in the storage portion 20 is pulled out by a pickup roller 211 provided in the image forming device body 201, and is transported to a sheet transport path (not illustrated) by a sheet feeding roller 212. An image is formed on the surface of a paper sheet P transported to the sheet transport path in the image forming unit. In the mounted state PA1, the direction in which a paper sheet P stored in the sheet feeding cassette 10 is fed is referred to as a sheet feeding direction D3.

The movable placement plate 21 is a member that upwardly pushes an end portion of a paper sheet P stored in the storage portion 20, and causes the paper sheet P to make contact with the pickup roller 211 provided in the image forming device body 201.

The sheet feeding device 100 includes a detector 30. The detector 30 is provided on the sheet feeding cassette mounting portion 206. The detector 30 makes contact with a paper sheet P stored in the sheet feeding cassette 10 in the mounted state PA1, and detects a paper sheet amount (the amount of paper sheets P or whether a paper sheet P is present). A sensor (not illustrated) that detects a displacement amount of the detector 30 is provided in the detector 30, and a detection signal from the sensor is input into a controller (not illustrated) provided inside the image forming device body 201 to determine the paper sheet amount.

Detector

Figure 4:
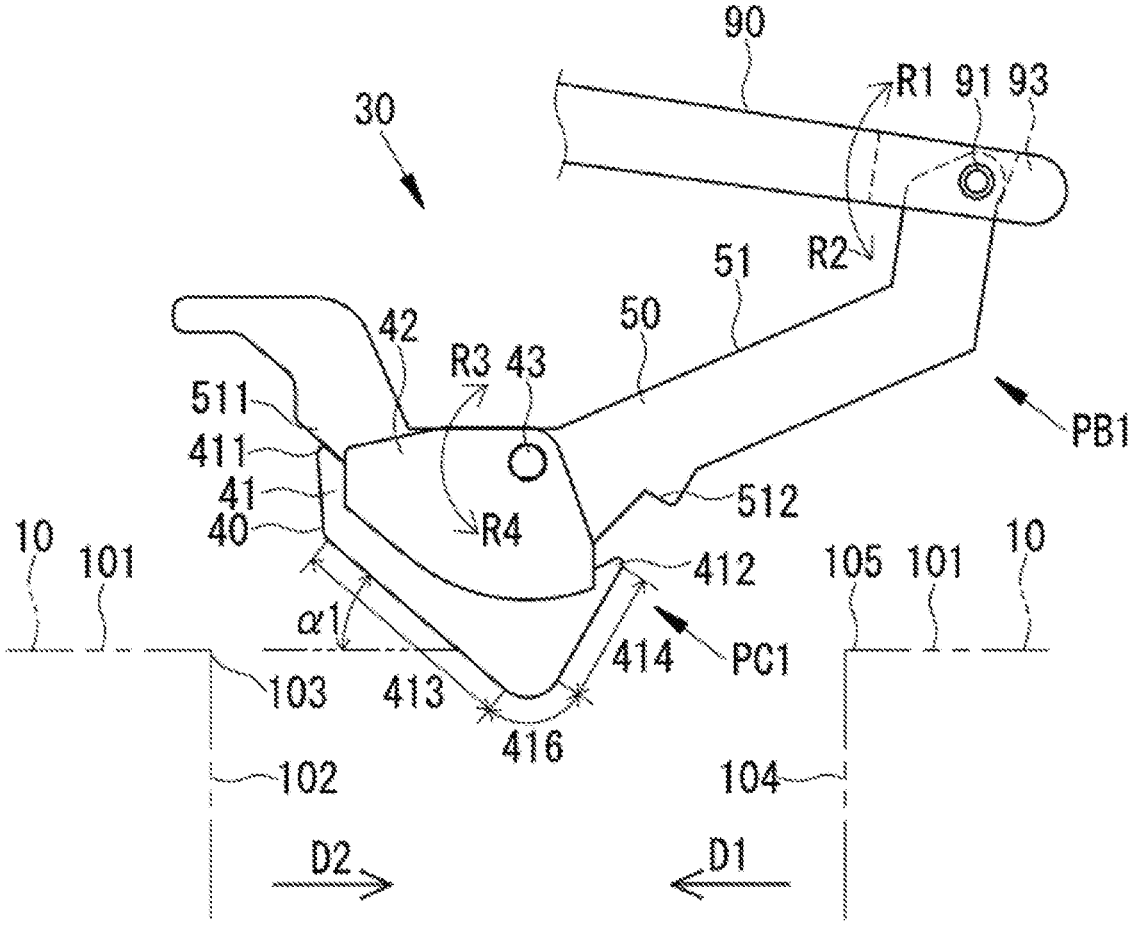
FIG. 4 is a side view of a detector viewed from the direction of arrow A in FIG. 2.
Figure 5:
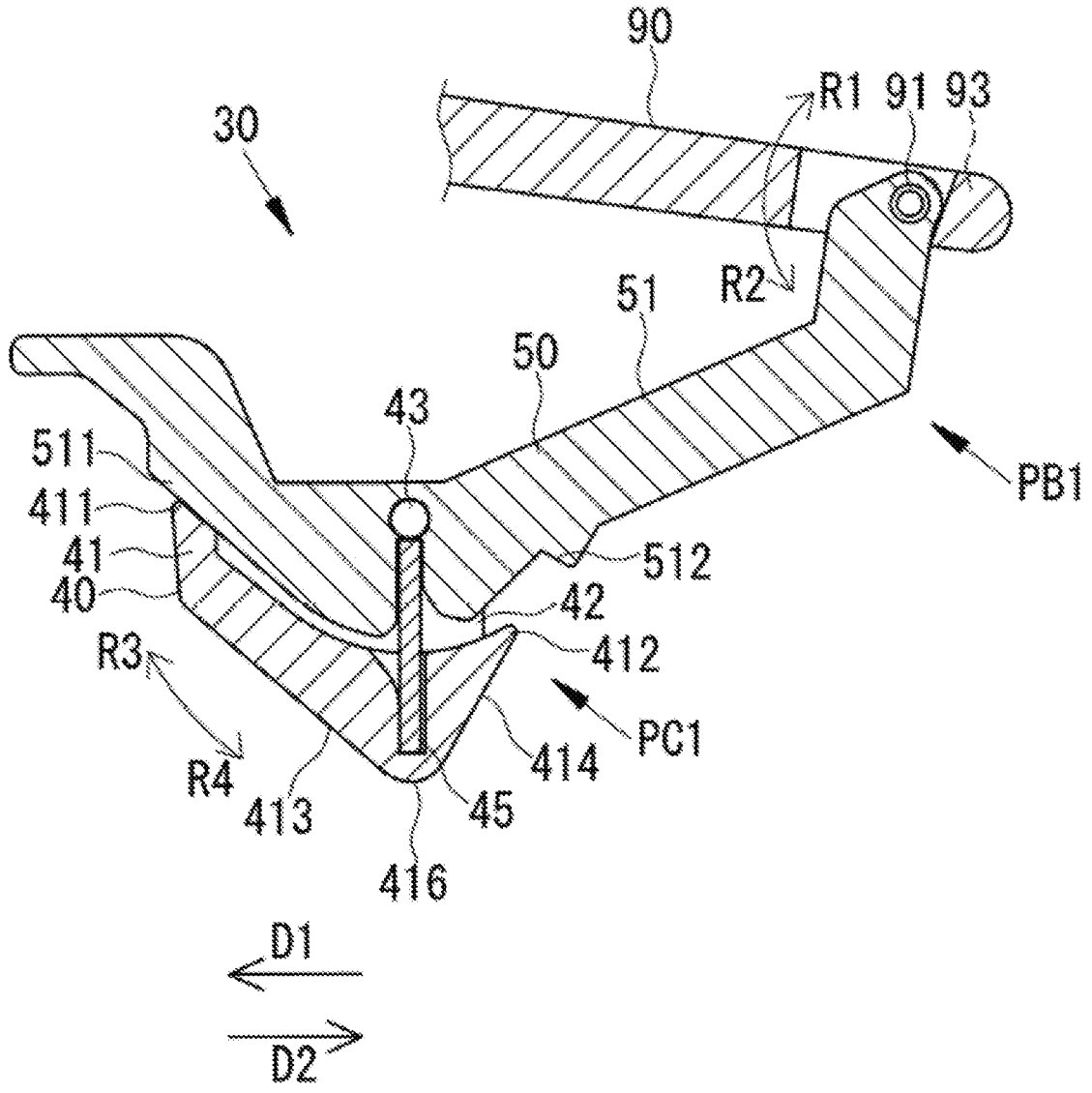
FIG. 5 is a side cross-sectional view of the detector at line B-B in FIG. 2.

FIG. 4 is a side view of the detector 30 viewed from the direction of arrow A in FIG. 2. FIG. 5 is a side cross-sectional view of the detector 30 at line B-B in FIG. 2. FIG. 4 respectively illustrates as two-dot chain lines an imaginary sheet feeding cassette 10 moving in the mounting direction D2 with respect to the detector 30, and an imaginary sheet feeding cassette 10 moving in the pull-out direction D1 with respect to the detector 30.

As illustrated in FIG. 4 the detector 30 includes a first member 40 and a second member 50. The first member 40 is a member that makes contact with an upper surface of a paper sheet P stored in the sheet feeding cassette 10. The second member 50 is a member which is rotatably supported by a support portion 90 provided on the sheet feeding cassette mounting portion 206, and which also supports the first member 40 such that it is capable of changing postures. The first member 40 moves in the up-and-down direction as a result of the second member 50 rotating with respect to the support portion 90. Hereinafter, the detector 30 will be described in detail.

As illustrated in FIG. 4 and FIG. 5, the second member 50 includes an arm portion 51. One end portion of the arm portion 51 is rotatably supported with respect to the support portion 90 by a support shaft 91. The directions in which the arm portion 51 rotates with respect to the support portion 90 are referred to as the R1 direction and the R2 direction. A rotation regulator 93 is formed on the support portion 90. The rotation regulator 93 abuts at a position where the arm portion 51 has rotated in the R2 direction, and restricts the rotational range of the arm portion 51. The arm portion 51, due to its own weight, rotates in the R2 direction and stops at a position where it abuts the rotation regulator 93. A posture in which the arm portion 51 abuts the rotation regulator 93 and extends diagonally downward from the support portion 90 toward the pull-out direction D1 is referred to as an initial posture PB1. The arm portion 51 is capable of rotating in the R1 direction from the initial posture PB1 where it abuts the rotation regulator 93. A posture in which the arm portion 51 has rotated in the R1 direction from the initial posture PB1 is referred to as a rotated posture PB2 (see FIG. 7 to FIG. 9). The second member 50 is capable of changing postures between the initial posture PB1 and the rotated posture PB2.

The first member 40 is provided on the other end portion of the arm portion 51. The first member 40 is rotatably supported with respect to the second member 50 by a support shaft 43. The directions in which the first member 40 rotates with respect to the second member 50 are referred to as the R3 direction and the R4 direction.

The first member 40 includes a first member main body 41, a holding portion 42, a support shaft 43, and a biasing member 45 (see FIG. 5).

The first member main body 41 is a section that makes contact with the sheet feeding cassette 10, which moves in the pull-out direction D1 and the mounting direction D2, and/or a paper sheet P stored in the sheet feeding cassette 10. The first member main body 41 is provided with a first abutting portion 411, a second abutting portion 412, a first guide portion 413, a second guide portion 414, and a contact portion 416.

The first abutting portion 411 is provided on one end portion of the first member main body 41. The first abutting portion 411 abuts the second member 50 when the first member 40 rotates in the R3 direction. A first restriction portion 511 that abuts the first abutting portion 411 and restricts the rotation of the first member 40 in the R3 direction is provided on the second member 50.

The second abutting portion 412 is provided on the other end portion of the first member main body 41. The second abutting portion 412 abuts the second member 50 when the first member 40 rotates in the R4 direction. A second restriction portion 512 that abuts the second abutting portion 412 and restricts the rotational range of the first member 40 in the R4 direction is provided on the second member 50. The second restriction portion 512 corresponds to the restriction portion of the present invention.

The first guide portion 413 is a section that makes contact with the sheet feeding cassette 10, which moves in the mounting direction D2 to switch between the mounted state PA1 and the pulled-out state PA2, and a paper sheet P stored in the sheet feeding cassette 10. The first guide portion 413 is disposed in a position making contact with the sheet feeding cassette 10, which is moved in the mounting direction D2, and a paper sheet P stored in the sheet feeding cassette 10. Specifically, the position of the first guide portion 413 is set such that it makes contact with a corner portion 103, at which an upper surface 101 of the sheet feeding cassette 10, which is moved in the mounting direction D2, intersects a front side surface 102 in the mounting direction D2, and with a corner portion P3, at which an upper surface P1 of a paper sheet P stored in the sheet feeding cassette 10, which moves in the mounting direction D2, intersects a front side surface P2 in the mounting direction D2 (see FIG. 10). The first guide portion 413 corresponds to the guide portion of the present invention.

The second guide portion 414 is a section that makes contact with the sheet feeding cassette 10, which moves in the pull-out direction D1 to switch between the mounted state PA1 and the pulled-out state PA2. The second guide portion 414 is disposed in a position making contact with the sheet feeding cassette 10, which moves in the pull-out direction D1. Specifically, the position of the second guide portion 414 is set such that it makes contact with a corner portion 105, at which an upper surface 101 of the sheet feeding cassette 10, which is moved in the pull-out direction D1, intersects a front side surface 104 in the pull-out direction D1.

The contact portion 416 is a section that makes contact with an upper surface P1 of a paper sheet P at the time a paper sheet amount of paper sheets P (the amount of paper sheets P or whether a paper sheet P is present) stored in the sheet feeding cassette 10 in the mounted state PA1 is detected.

The holding portion 42 is a section which is joined with the second member 50. As illustrated in FIG. 4 and FIG. 5, the holding portion 42 is provided on both sides of the first member main body 41. A spacing is formed in the holding portion 42 that enables the second member 50 to be sandwiched in between. The second member 50 passes through the spacing formed by the holding portion 42.

The support shaft 43 is a member that rotatably connects the first member 40 and the second member 50. The support shaft 43 is provided so as to pass through the holding portion 42 and the second member 50 in a state where the second member 50 is passing through the spacing formed by the holding portion 42.

As illustrated in FIG. 5, the biasing member 45 is provided between the first member 40 and the second member 50. The biasing member 45 biases the first member 40 with respect to the second member 50 in the R3 direction, and rotates the first member 40 such that the first abutting portion 411 abuts the first restriction portion 511. The posture of the first member 40 when the first abutting portion 411 abuts the first restriction portion 511 is referred to as a detection posture PC1. In other words, the biasing member 45 biases the first member 40 with respect to the second member 50 such that the first member 40 takes the detection posture PC1.

Figure 6:
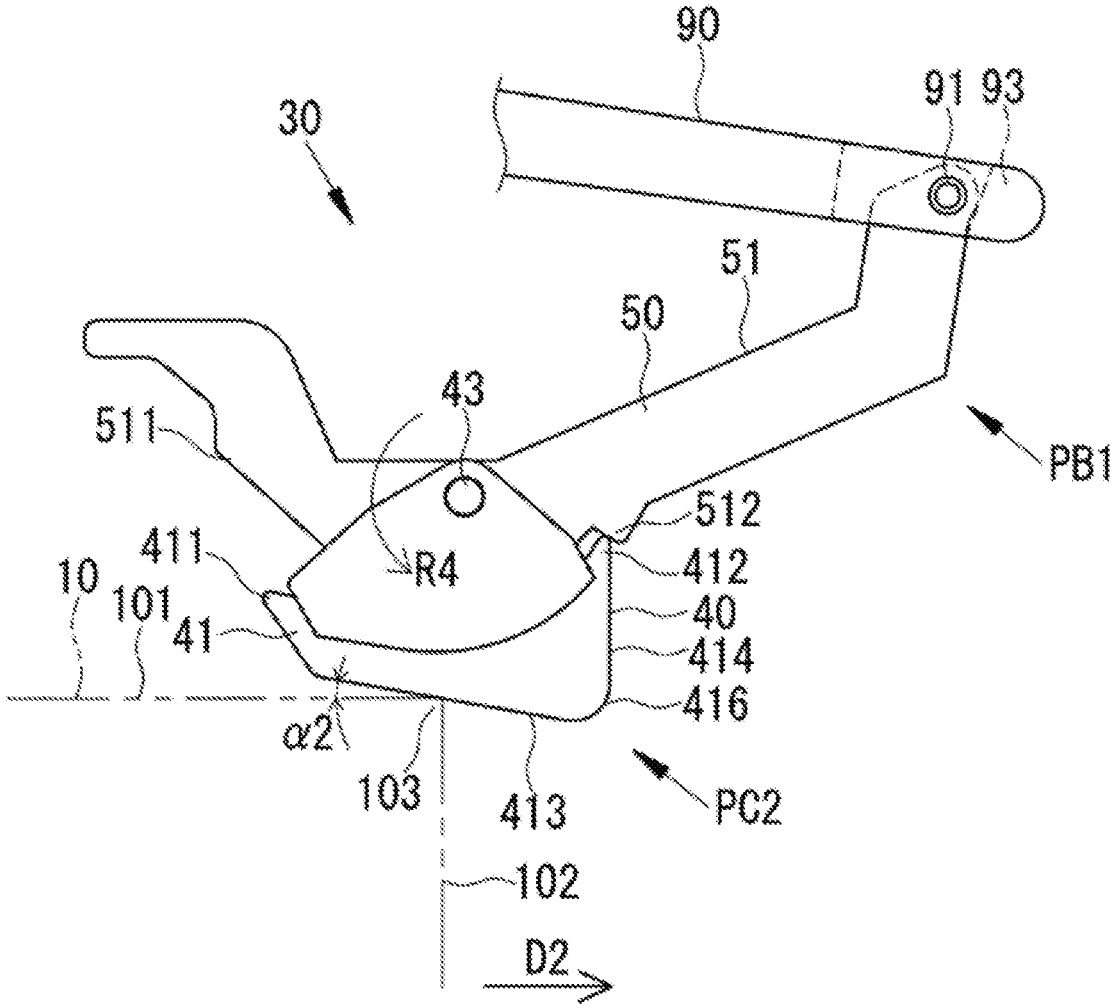
FIG. 6 is a side view illustrating an operation of the detector.
Figure 7:
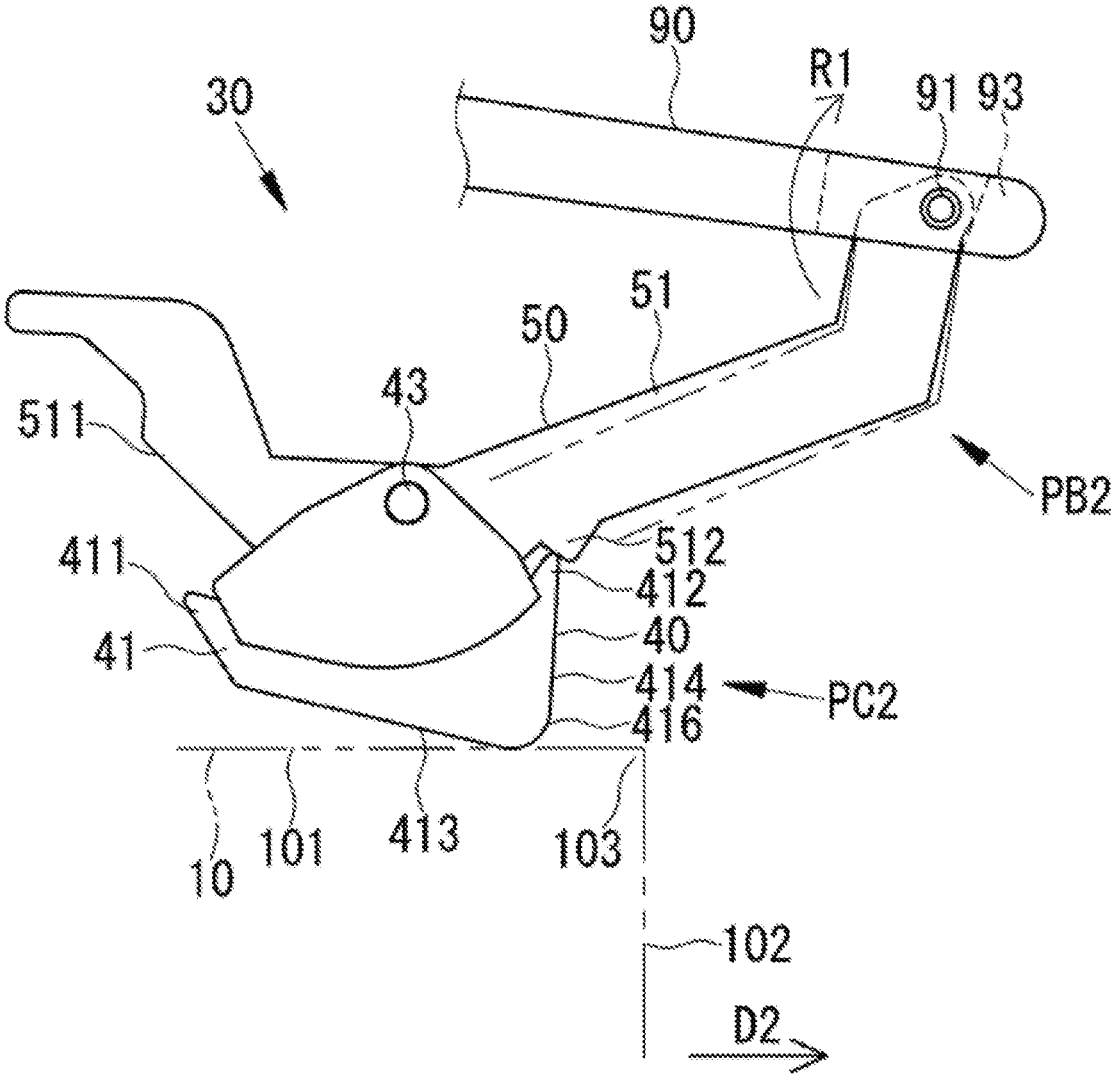
FIG. 7 is a side view illustrating an operation of the detector.

A posture in which the first member 40 has rotated in the R4 direction against the biasing force of the biasing member 45 is referred to as a guiding posture PC2 (see FIG. 6 and FIG. 7). The first member 40 is capable of being rotated in the R4 direction to a position at which the second abutting portion 412 abuts the second restriction portion 512.

Description of Operation of First Member and Second Member of Detector

Next, an operation of the detector 30 when the sheet feeding cassette 10, which moves in the mounting direction D2 or the pull-out direction D1, makes contact with the detector 30 will be described. FIG. 6 to FIG. 9 are side views illustrating an operation of the detector 30.

First, an operation of the first member 40 and the second member 50 when the sheet feeding cassette 10 is moving in the mounting direction D2 and has made contact with the first guide portion 413 of the first member 40 will be described.

As illustrated in FIG. 4 and FIG. 6, when the sheet feeding cassette 10 moving in the mounting direction D2 makes contact with the first guide portion 413 of the first member 40, the first member 40 receives a pressing force from the sheet feeding cassette 10 and rotates in the R4 direction with respect to the second member 50. As a result of the first member 40 rotating in the R4 direction and the changing postures from the detection posture PC1 to the guiding posture PC2, the impact received by the detector 30 from the sheet feeding cassette 10 is reduced. As illustrated in FIG. 6, the first member 40 is restricted from rotating beyond a position at which the second abutting portion 412 abuts the second restriction portion 512.

As illustrated in FIG. 4 and FIG. 6, the angle formed by the first guide portion 413 and the upper surface 101 of the sheet feeding cassette 10 decreases as a result of the posture of the first member 40 changing from the detection posture PC1 to the guiding posture PC2. Specifically, given an angle $\alpha 1$ formed by the first guide portion 413 and the upper surface 101 of the sheet feeding cassette 10 in FIG. 4, and an angle $\alpha 2$ formed by the first guide portion 413 and the upper surface 101 of the sheet feeding cassette 10 in FIG. 6, the angle $\alpha 2$ becomes smaller than the angle $\alpha 1$. Consequently, the first guide portion 413 more easily moves up onto the upper surface 101 of the sheet feeding cassette 10.

As illustrated in FIG. 6 and FIG. 7, when the sheet feeding cassette 10 moves further in the mounting direction D2, because the rotation of the first member 40 with respect to the second member 50 is restricted, the second member 50 rotates in the R1 direction and changes postures from the initial posture PB1 to the rotated posture PB2. Consequently, the first guide portion 413 of the first member 40 moves up onto the upper surface 101 of the sheet feeding cassette 10.

Figure 8:
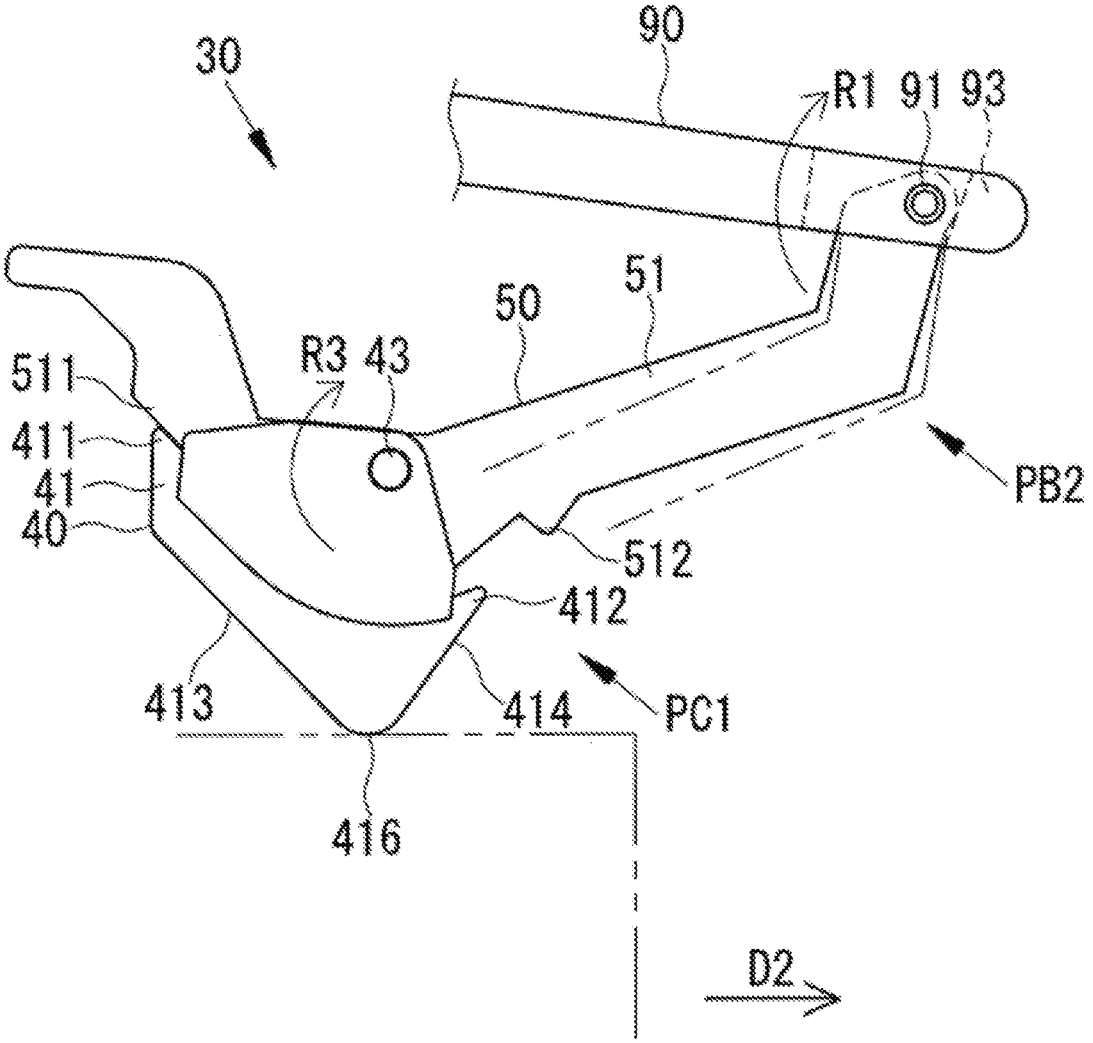
FIG. 8 is a side view illustrating an operation of the detector.

As illustrated in FIG. 8, when the sheet feeding cassette 10 separates from the first guide portion 413, the first member 40 no longer receives a pressing force from the sheet feeding cassette 10. Consequently, the first member 40 rotates in the R3 direction with respect to the second member 50 as a result of the biasing force of the biasing member 45, and changes postures from the guiding posture PC2 to the detection posture PC1.

The biasing force of the biasing member 45 is set to a strength where, in a state where the first member 40 is positioned on the upper surface P1 of the sheet feeding cassette 10 and no longer receives a pressing force from the sheet feeding cassette 10, the first member 40 takes the detection posture PC1.

Next, an operation of the first member 40 and the second member 50 when the sheet feeding cassette 10 is moving in the pull-out direction D1 and has made contact with the second guide portion 414 of the first member 40 will be described.

Figure 9:
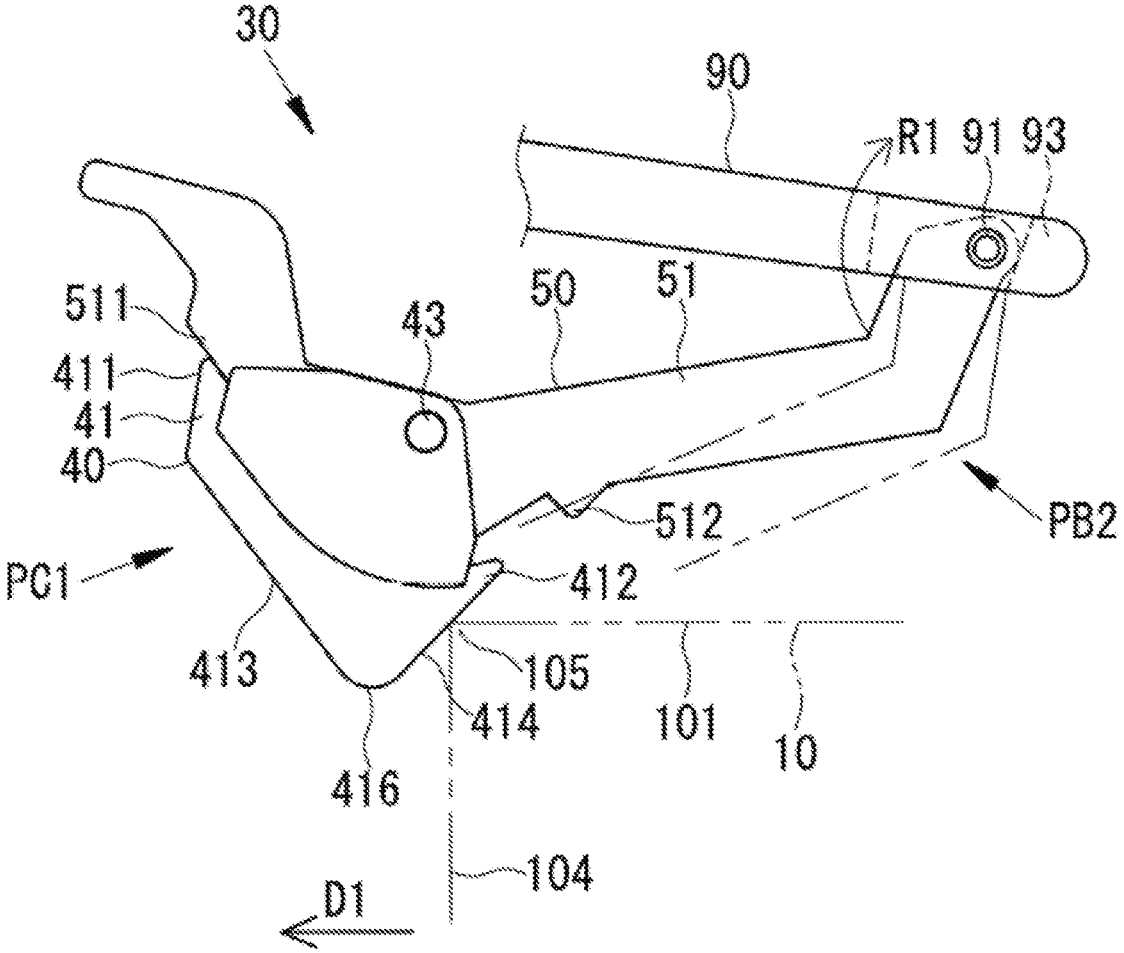
FIG. 9 is a side view illustrating an operation of the detector.

As illustrated in FIG. 9, the posture of the first member 40 with respect to the second member 50 is the detection posture PC1 due to the biasing force of the biasing member 45. Consequently, even when the sheet feeding cassette 10 is moving in the pull-out direction D1 and makes contact with the second guide portion 414 of the first member 40, the first member 40 does not rotate in the R3 direction with respect to the second member 50. On the other hand, the second member 50 rotates in the R1 direction due to of the pressing force received by the first member 40 from the sheet feeding cassette 10, and changes postures from the initial posture PB1 to the rotated posture PB2. As a result of the second member 50 changing postures from the initial posture PB1 to the rotated posture PB2, the impact received by the detector 30 from the sheet feeding cassette 10 is reduced.

Description of Operation of Detector

Next, an operation of the detector 30 in a state where the detector 30 is making contact with the sheet feeding cassette 10 and with a paper sheet P stored in the sheet feeding cassette 10 will be described. FIGS. 10 to 13 are a simplified side views illustrating an operation of the detector 30 in a state where the detector 30 is in contact with the sheet feeding cassette 10, which is moving in the mounting direction D2, and with a paper sheet P stored in the sheet feeding cassette 10. FIG. 14 is a simplified side view illustrating an operation of the detector 30 in a state where the detector 30 is in contact with the sheet feeding cassette 10, which is moving in the pull-out direction D1, and with a paper sheet P stored in the sheet feeding cassette 10.

Figure 10:
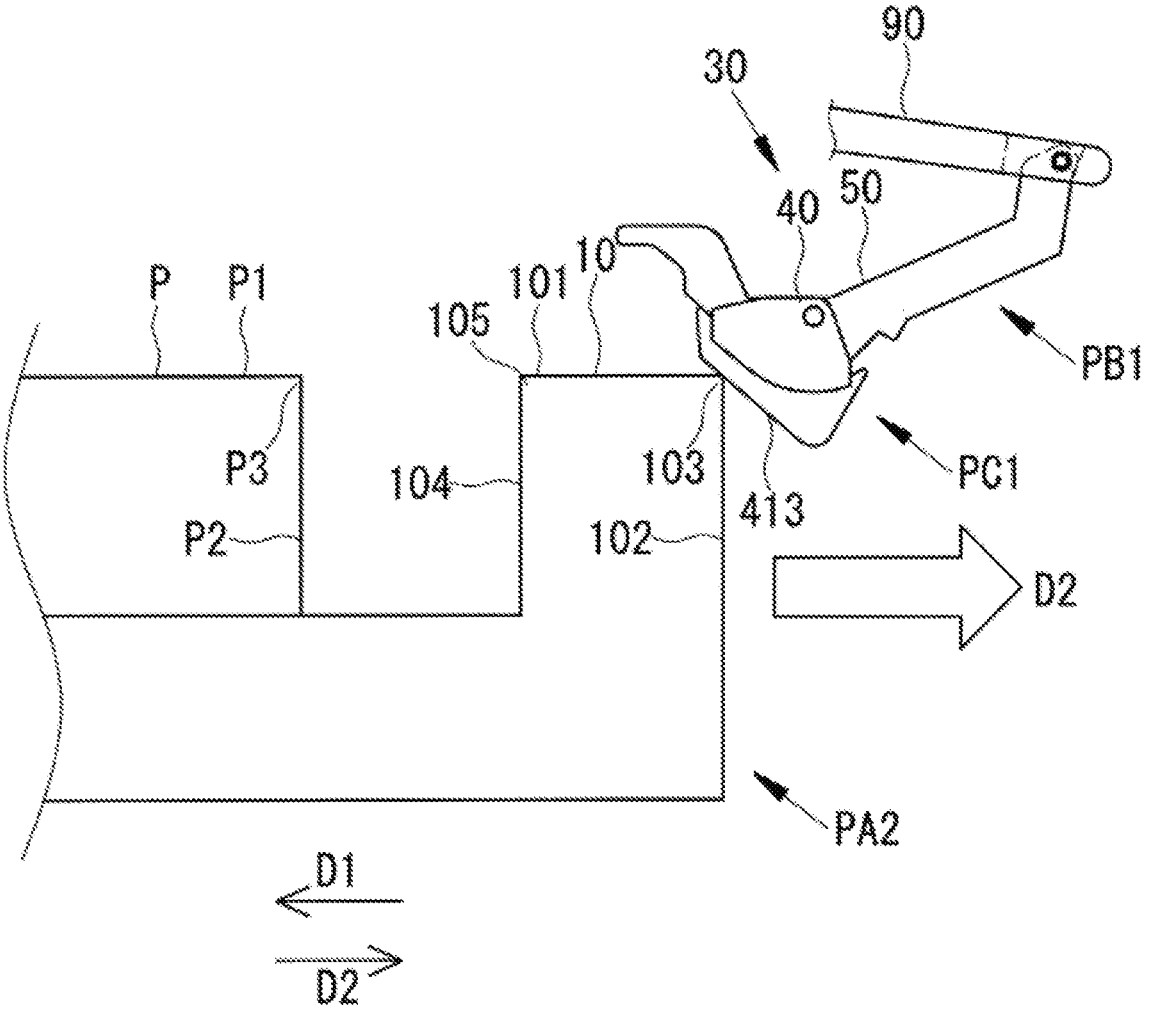
FIG. 10 is a simplified side view illustrating an operation of the detector in a state where the detector is making contact with the sheet feeding cassette, which is moving in the mounting direction, and with a paper sheet stored in the sheet feeding cassette.
Figure 11:
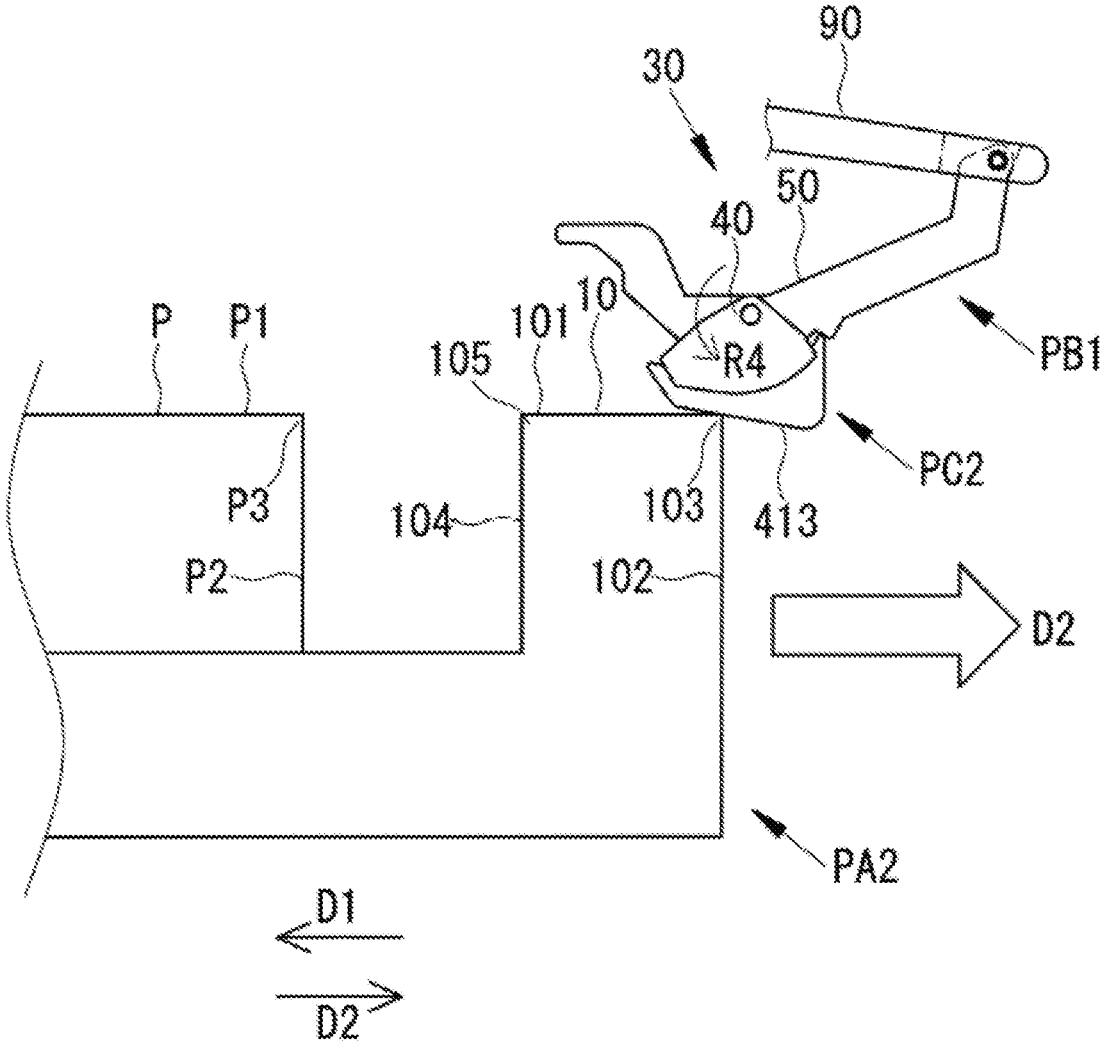
FIG. 11 is a simplified side view illustrating an operation of the detector in a state where the detector is making contact with the sheet feeding cassette, which is moving in the mounting direction, and with a paper sheet stored in the sheet feeding cassette.

FIG. 10 and FIG. 11 illustrate a state where the corner portion 103 of the sheet feeding cassette 10, which is moving in the mounting direction D2, has made contact with the first guide portion 413 of the first member 40. As illustrated in FIG. 10, when the corner portion 103 of the sheet feeding cassette 10 makes contact with the first guide portion 413 of the first member 40, as illustrated in FIG. 11, the posture of the first member 40 changes from the detection posture PC1 to the guiding posture PC2, and the impact received by the detector 30 from the sheet feeding cassette 10 is reduced.

Furthermore, as a result of the posture of the first member 40 changing from the detection posture PC1 to the guiding posture PC2, the angle formed by the first guide portion 413 and the upper surface 101 of the sheet feeding cassette 10 is reduced. Consequently, the first guide portion 413 more easily moves up onto the upper surface 101 of the sheet feeding cassette 10.

Figure 12:
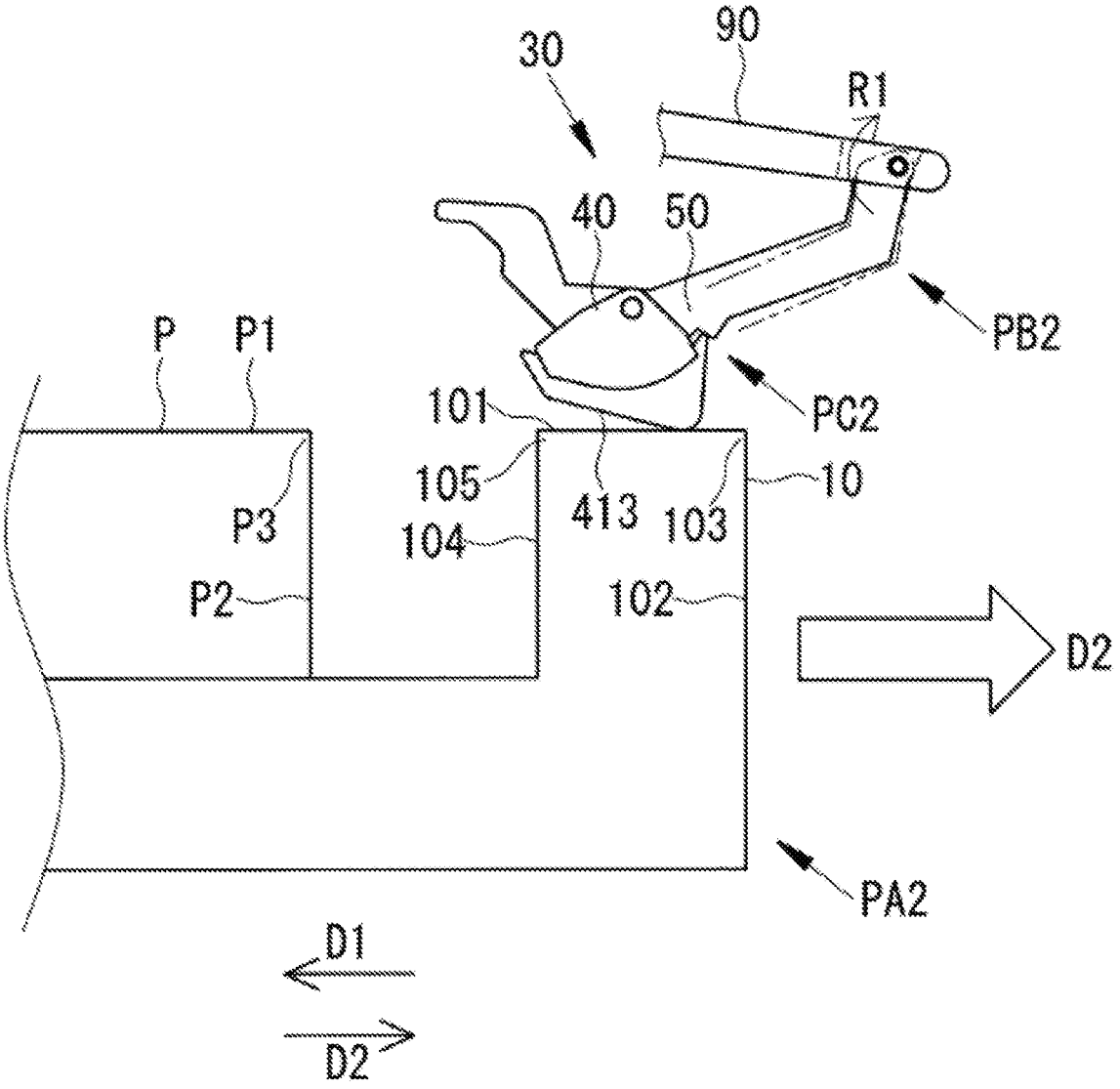
FIG. 12 is a simplified side view illustrating an operation of the detector in a state where the detector is making contact with the sheet feeding cassette, which is moving in the mounting direction, and with a paper sheet stored in the sheet feeding cassette.

FIG. 12 illustrates a state where the first member 40 has moved up onto the upper surface 101 of the sheet feeding cassette 10, which is moving in the mounting direction D2. As illustrated in FIG. 12, because the rotation of the first member 40 with respect to the second member 50 is restricted, the second member 50 rotates in the R1 direction and changes postures from the initial posture PB1 to the rotated posture PB2. Consequently, the first guide portion 413 of the first member 40 moves up onto the upper surface 101 of the sheet feeding cassette 10.

Figure 13:
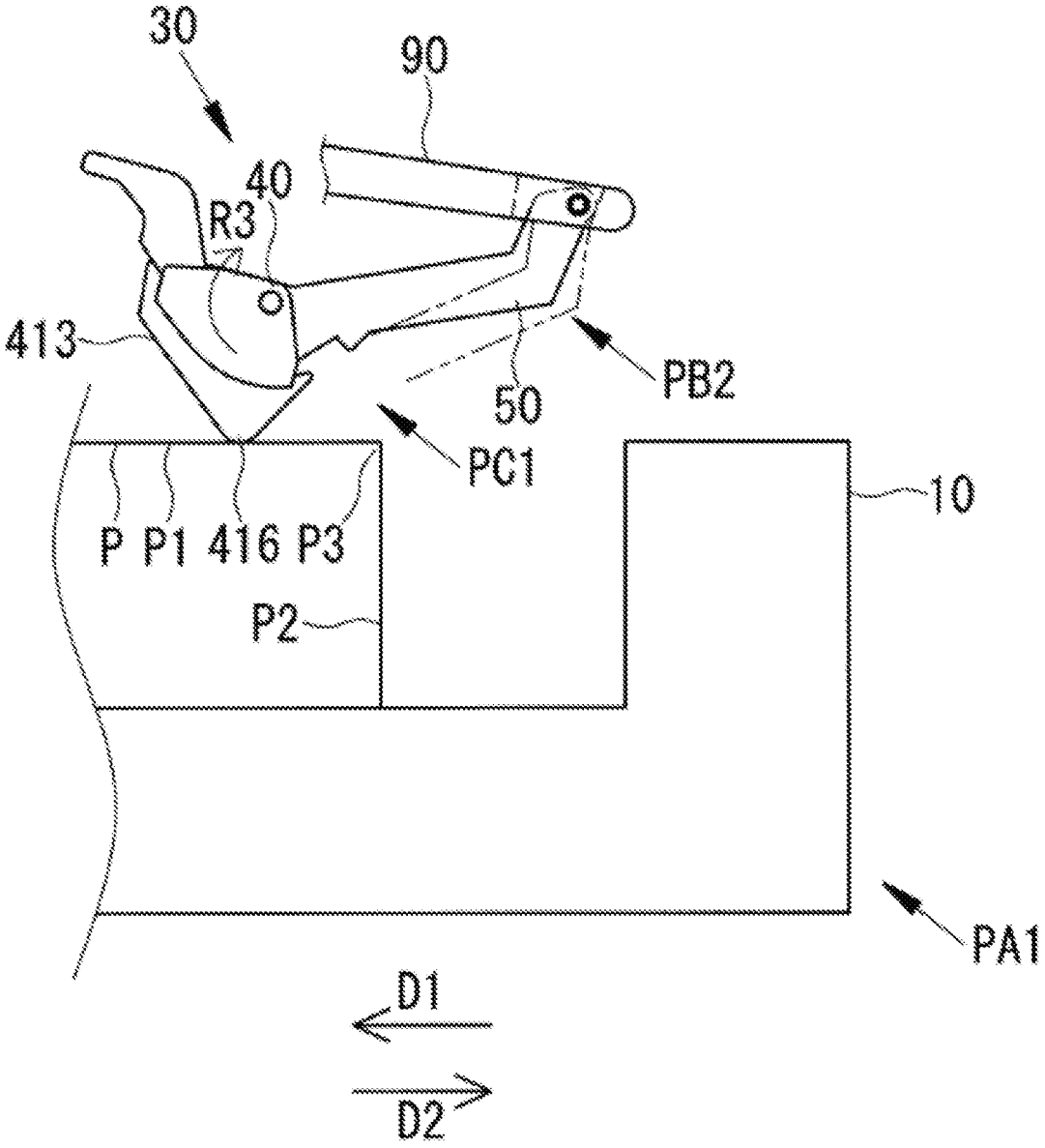
FIG. 13 is a simplified side view illustrating an operation of the detector in a state where the detector is making contact with the sheet feeding cassette, which is moving in the mounting direction, and with a paper sheet stored in the sheet feeding cassette.
Figure 14:
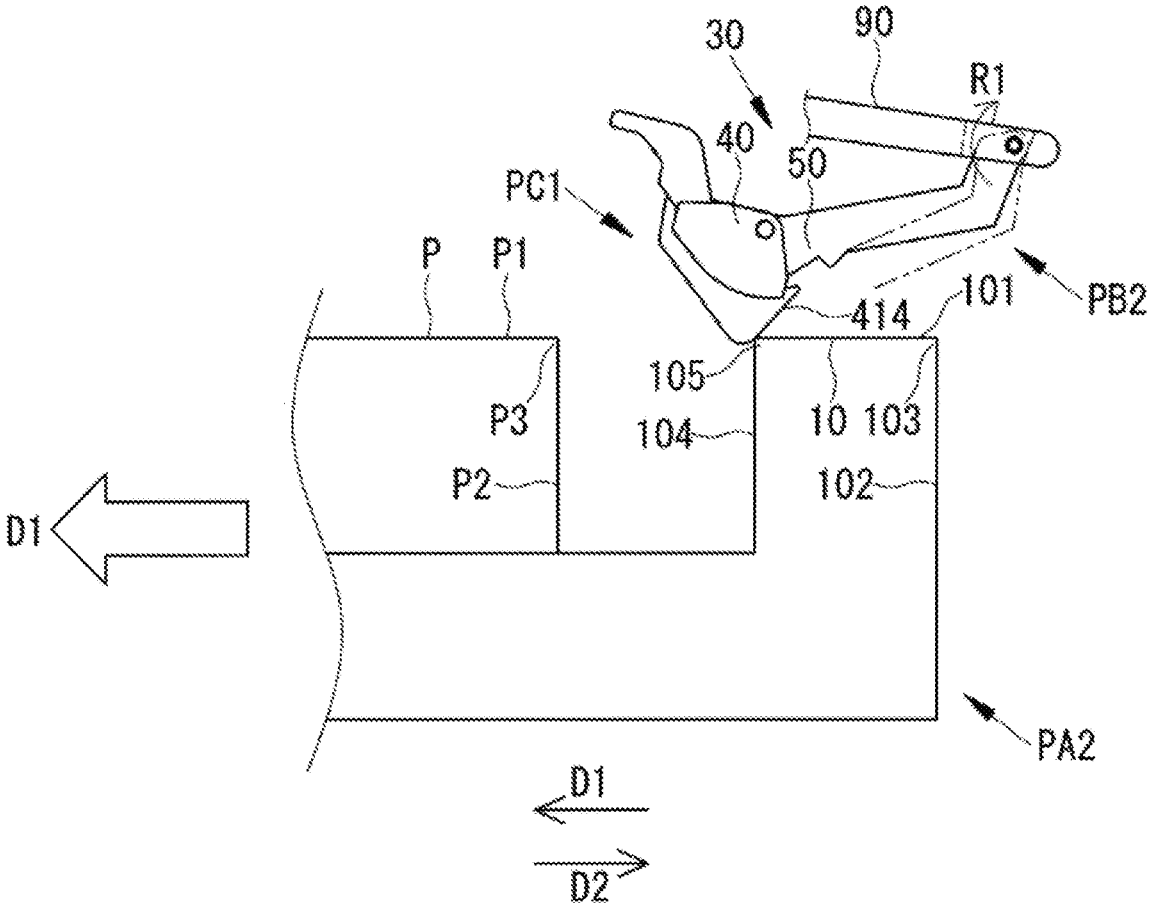
FIG. 14 is a simplified side view illustrating an operation of the detector in a state where the detector is making contact with the sheet feeding cassette, which is moving in the pull-out direction, and with a paper sheet stored in the sheet feeding cassette.
Figure 15A:
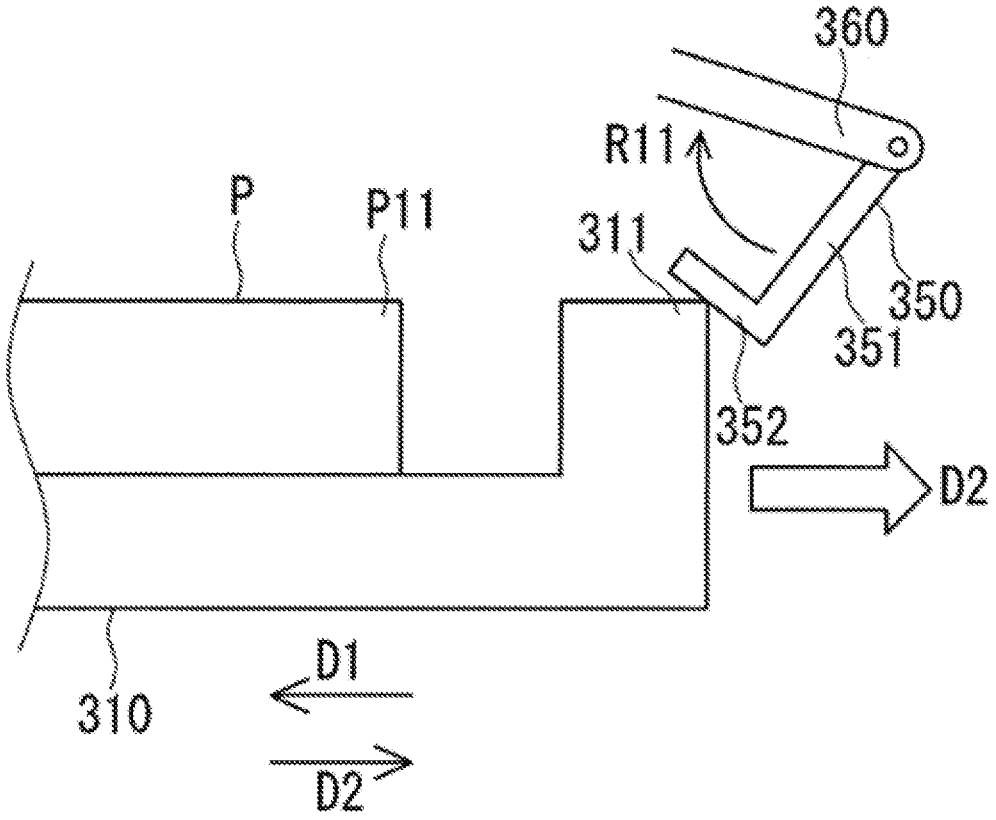
FIGS. 15 A to 15C are simplified side views illustrating an operation of a conventional sheet feeding cassette and detector.
Figure 15B:
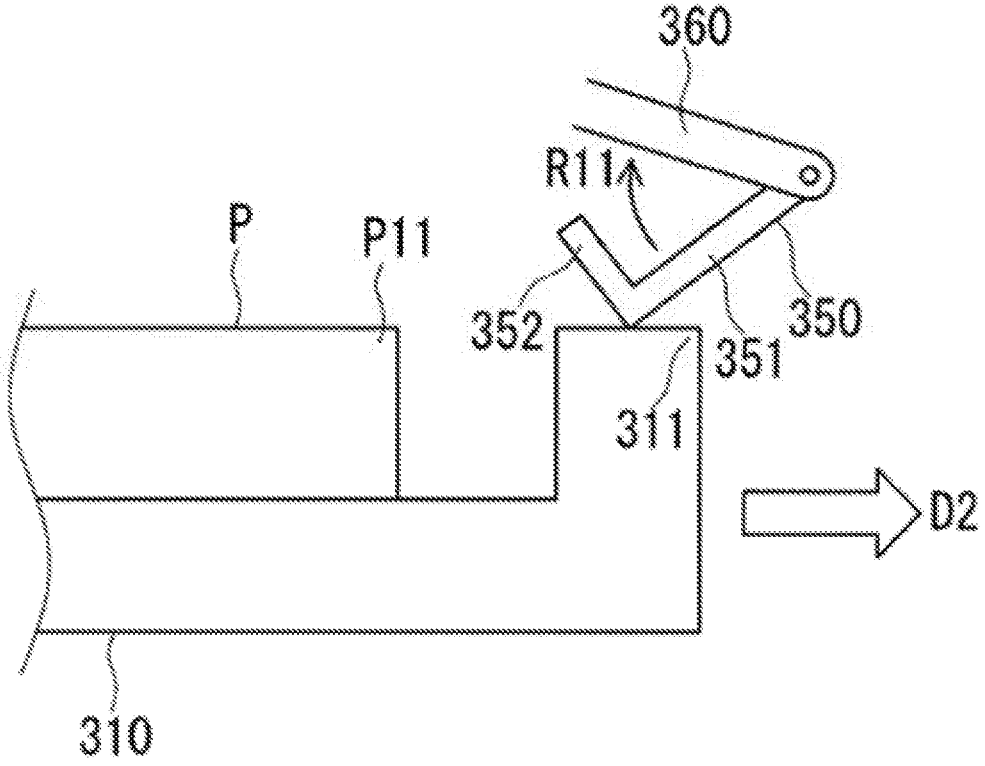
Figure 15C:
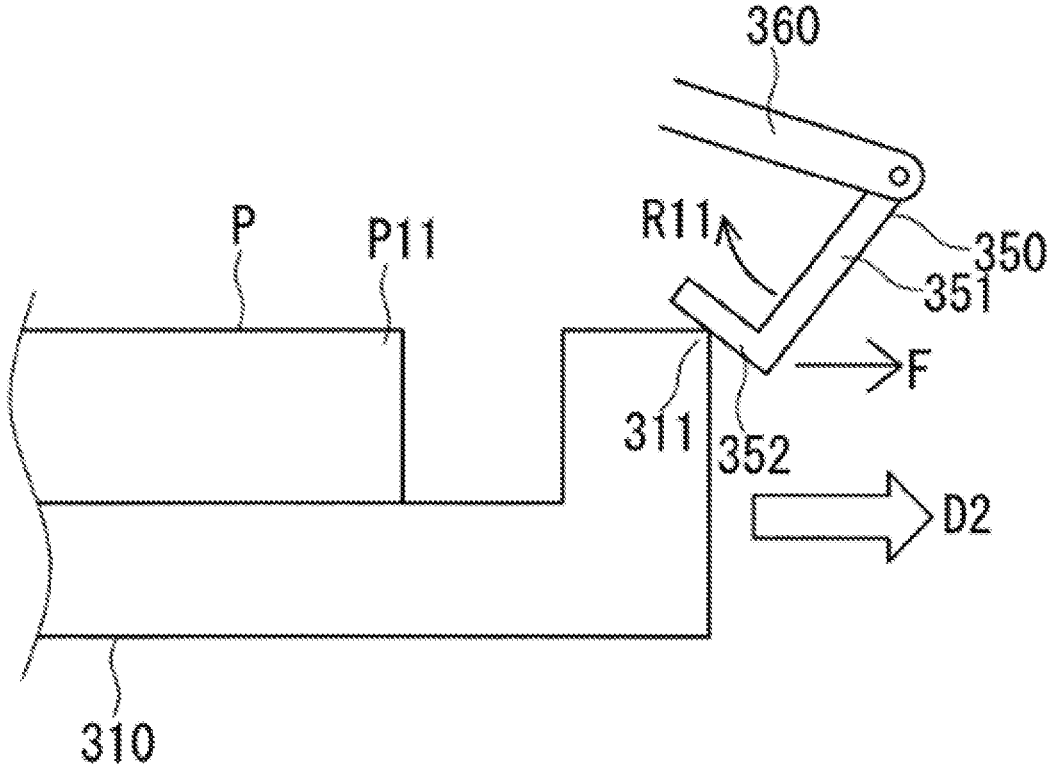

FIG. 13 illustrates a state where the first member 40 has moved up onto the upper surface P1 of a paper sheet P stored in the sheet feeding cassette 10, which is in the mounted state PA1. When the first member 40 makes contact with a corner portion P3 of a paper sheet P before moving up onto the upper surface P1 of the paper sheet P, similarly to those cases where the first member 40 makes contact with the corner portion 103 of the sheet feeding cassette 10 (see FIG. 10 to FIG. 12), the posture of the first member 40 changes from the detection posture PC1 to the guiding posture PC2, and the impact received by the detector 30 from the corner portion P3 of a paper sheet P is reduced.

In the state of FIG. 13, the posture of the first member 40 has changed to the detection posture PC1, and the contact portion 416 is making contact with the upper surface P1 of a paper sheet P. As a result of the contact portion 416 making contact with the upper surface P1 of a paper sheet P, a paper sheet amount of paper sheets P (the amount of paper sheets P or whether a paper sheet P is present) stored in the sheet feeding cassette 10 in the mounted state PA1 is detected.

FIG. 14 illustrates a state where the corner portion 105 of the sheet feeding cassette 10, which is moving in the pull-out direction D1, has made contact with the second guide portion 414 of the first member 40. When the corner portion 105 of the sheet feeding cassette 10 makes contact with the second guide portion 414 of the first member 40, the second member 50 rotates in the R1 direction due to the pressing force received by the first member 40 from the sheet feeding cassette 10, and the posture changes from the initial posture PB1 to the rotated posture PB2. As a result of the posture of the second member 50 changing from the initial posture PB1 to the rotated posture PB2, the impact received by the detector 30 from the corner portion 105 of the sheet feeding cassette 10 is reduced.

According to the sheet feeding device 100 described above, the first member 40 changes a posture with respect to the second member 50 as a result of the first guide portion 413 making contact with the sheet feeding device 10 and a paper sheet P stored in the sheet feeding cassette 10. Consequently, the impact received by the detector 30 can be reduced when the sheet feeding cassette 10, which is moved to switch between the mounted state PA1 and the pulled-out state PA2, and a paper sheet P stored in the sheet feeding cassette 10 make contact with the detector 30.

Second Embodiment

Next, a sheet feeding device 100A according to a second embodiment of the present invention will be described. In the sheet feeding device 100 according to the first embodiment, the first member 40 of the detector 30 was configured to change postures by rotating with respect to the second member 50. In the sheet feeding device 100A according to the second embodiment, a first member 40A is configured to change postures by being slidably provided with respect to a second member 50A. In this case, the posture of the first member 40A can be changed to a variety of postures.

Third Embodiment

Next, a sheet feeding device 100B according to a third embodiment of the present invention will be described. In the sheet feeding device 100B according to the third embodiment, a first member 40B of a detector 30B is configured to change postures with respect to a second member 50B toward the sheet feeding direction D3. In this case, friction between a paper sheet P and the first member 40B can be reduced when a paper sheet P is fed, thereby inhibiting the generation of abnormal noise.

Other Embodiments

The embodiments disclosed here are exemplary in all respects, and is not a basis for a limited interpretation. Therefore, the technical scope of the present invention is not only interpreted by the above embodiments, but is also defined based on the scope of the claims. Furthermore, the technical scope of the present invention includes all modifications within the meaning and scope equivalent to the claims.

For example, the shapes of the first member and the second member that constitute the detector are not limited by the above embodiments. Furthermore, the embodiments described above were configured such that the first member 40 changes postures with respect to the second member 50 when the sheet feeding cassette 10 moves in the mounting direction D2.

However, a configuration may also be used in which the first member 40 changes postures with respect to the second member 50 when the sheet feeding cassette 10 moves in the pull-out direction D1.

INDUSTRIAL APPLICABILITY

The present invention can be applied to a sheet feeding device provided with a sheet feeding cassette, and an image forming device provided with a sheet feeding device.

What is claimed is:

1. A sheet feeding device comprising:

a sheet feeding cassette which is switchable between a mounted state, in which the sheet feeding cassette is mounted to a sheet feeding cassette mounting portion on an image forming device body, and a pulled-out state, in which the sheet feeding cassette has been pulled out from the sheet feeding cassette mounting portion, wherein a detector is provided that makes contact with a paper sheet stored in the sheet feeding cassette and detects a paper sheet amount, the detector includes a first member that makes contact with an upper surface of the paper sheet stored in the sheet feeding cassette, and a second member that supports the first member such that the first member is capable of changing postures, while also movably supporting the first member in an up-and-down direction to coincide with the upper surface of the paper sheet stored in the sheet feeding cassette, the first member includes a guide portion that makes contact with the sheet feeding cassette, which is moved to switch between the mounted state and the pulled-out state, and/or the paper sheet stored in the sheet feeding cassette, and the first member changes a posture with respect to the second member as a result of the guide portion making contact with the sheet feeding cassette, which is moved to switch between the mounted state and the pulled-out state, and/or the paper sheet stored in the sheet feeding cassette, the second member includes a restriction portion that restricts a posture change of the first member with respect to the second member to a predetermined range when the guide portion is making contact with the sheet feeding cassette and/or the paper sheet stored in the sheet feeding cassette, and the first member changes the posture as a result of the guide portion making contact with the sheet feeding cassette, which is moved to switch between the mounted state and the pulled-out state, and/or the paper sheet stored in the sheet feeding cassette, so that the first member abuts the restriction portion, and the second member moves the first member in the up-and-down direction in a state where the first member abuts the restriction portion according to the movement of the sheet feeding cassette.

2. The sheet feeding device according to claim 1, wherein the guide portion is disposed so as to make contact with a section in which an upper surface of the sheet feeding cassette intersects a front side surface of the sheet feeding cassette in a mounting direction and/or a section in which the upper surface of the paper sheet stored in the sheet feeding cassette intersects a front side surface of the paper sheet stored in the sheet feeding cassette in the mounting direction, the mounting direction being a direction in which the sheet feeding cassette is moved when switching from the pulled-out state to the mounted state.

3. The sheet feeding device according to claim 1, wherein the first member changes the posture with respect to the second member as a result of the guide portion making contact with the sheet feeding cassette and/or the paper sheet stored in the sheet feeding cassette, such that an angle formed by the guide portion and an upper surface of the sheet feeding cassette and/or the upper surface of the paper sheet stored in the sheet feeding cassette decreases.

4. The sheet feeding device according to claim 1, wherein the first member is rotatably provided with respect to the second member.

5. The sheet feeding device according to claim 1, further comprising a biasing member that biases the first member with respect to the second member such that the first member takes a detection posture, the detection posture being a posture of the first member with respect to the second member in a state where the guide portion is not making contact with the sheet feeding cassette and/or the paper sheet stored in the sheet feeding cassette.

6. The sheet feeding device according to claim 5, wherein the biasing member has a biasing force which is set such that the first member takes the detection posture when the first member is positioned on an upper surface of the sheet feeding cassette and/or the paper sheet stored in the sheet feeding cassette.

7. An image forming device comprising, the sheet feeding device according to claim 1.

* * * * *